US006130185A

United States Patent [19]

Narita et al.

[11] Patent Number: 6,130,185

[45] Date of Patent: Oct. 10, 2000

[54] THERMAL TRANSFER-RECEIVING SHEET AND METHOD FOR MANUFACTURING SAME

[75] Inventors: Satoshi Narita; Takayuki Imai, both of Tokyo-to, Japan

[73] Assignee: Dai Nippon Printing Co., Ltd., Tokyo-to, Japan

[21] Appl. No.: 09/113,251

[22] Filed: Jul. 10, 1998

[30] Foreign Application Priority Data

| | | | |
|---|---|---|---|
| Jul. 11, 1997 | [JP] | Japan | 9-201041 |
| Mar. 31, 1998 | [JP] | Japan | 10-104031 |
| Mar. 31, 1998 | [JP] | Japan | 10-104032 |

[51] Int. Cl.[7] ..... B41M 5/035; B41M 5/38

[52] U.S. Cl. ..... 503/227; 427/146; 427/152; 427/195; 428/327; 428/409

[58] Field of Search ..... 428/195, 913, 428/914, 327, 409; 503/227; 8/471; 427/146, 152, 180, 189, 195

[56] References Cited

FOREIGN PATENT DOCUMENTS

| | | |
|---|---|---|
| 0501011 | 9/1992 | European Pat. Off. . |
| 0782934 | 6/1997 | European Pat. Off. . |
| 04347658 | 12/1992 | Japan . |
| 05155154 | 6/1993 | Japan . |
| 08025811 | 1/1996 | Japan . |
| 08224970 | 9/1996 | Japan . |
| 09136489 | 5/1997 | Japan . |
| 09142045 | 6/1997 | Japan . |

*Primary Examiner*—Bruce H. Hess
*Attorney, Agent, or Firm*—Ladas & Parry

[57] ABSTRACT

A thermal transfer-receiving sheet of the present invention comprise a substrate made of a plain paper and a receptor layer formed by applying, on the substrate, a powdery composition containing a dyeable resin. The receptor layer has a coated amount in a range of 6 g/m$^2$ or more and 22 g/m$^2$ or less, or alternately has a substantial thickness in a range of 7 $\mu$m or more, which is defined by excluding a portion of the receptor layer infiltrating the substrate. A surface of the substrate may has physical properties in which a surface texture is in a range of 471 or less in terms of a roughness index, and a surface roughness is in a range of less than 2.1 $\mu$m in terms of an arithmetical mean deviation of profile(Ra), less than 23.2 $\mu$m in terms of a maximum height (Rmax) and less than 20.8 $\mu$m in terms of a mean roughness of ten points(Rz)

19 Claims, 2 Drawing Sheets

THERMAL TRANSFER-RECEIVING SHEET AND METHOD FOR MANUFACTURING SAME

BACKGROUND OF THE INVENTION

1. Field of the Invention

The present invention relates to a thermal transfer-receiving sheet to be used in combination with a thermal transfer sheet. More specifically, the present invention relates to a thermal transfer-receiving sheet comprising a plain paper on which a receptor layer is formed by using a powdery composition and also to a method for manufacturing the thermal transfer-receiving sheet.

2. Description of the Related Art

Heretofore, various types of thermal transfer recording methods have been known. As one of them, there is known a sublimation type transfer recording method wherein a sublimation dye is used as a coloring material so that an image is obtained by transferring the sublimation dye to a thermal transfer image receiving sheet by use of a thermal head which generates heat in response to recorded signals. Recently, the sublimation type transfer recording is utilized as an image forming means in various fields. Since the sublimation dye is used as a coloring material, the gradation of a printing density can be controlled at will to reproduce a full color image in accordance with the original image in the sublimation type transfer recording.

Furthermore, since the image formed of the dye is very clear and excellent in transparency, the reproduction of intermediate colors and the reproduction of gradation in the image are excellent, thus enabling to form a high-quality image comparable to a silver salt-based photographic image.

As for the thermal transfer-receiving sheet for use in thermal transfer recording methods, there is known a thermal transfer-receiving sheet which comprises a plastic sheet or a synthetic paper as a substrate whose one side or both sides are provided with a dye receptor layer comprising a dyeable resin.

Also proposed is a thermal transfer-receiving sheet which comprises a plain paper as a substrate. The image formed on the thermal transfer-receiving sheet which uses a plain paper as a substrate is comparable to a printed product obtained by an ordinary printing method in terms of feel such as surface gloss and thickness. Further, contrary to the thermal transfer-receiving sheet using the plastic sheet or the synthetic paper as a substrate, the thermal transfer-receiving sheet using the plain paper as the substrate is advantageous in, for example, that it can be bent and that bookbinding or filing of even a stack of several sheets of it is possible. Furthermore, since the plain paper is cheaper than the synthetic film or sheet, the thermal transfer-receiving sheet using the plain paper can be manufactured at a lower cost.

In the case of the thermal transfer-receiving sheet using the plain paper as the substrate, in order to obtain a high-quality image, it is necessary to solve problems such as minute irregularity of the surface and lack of cushioning property. Some methods have been proposed to solve these problems.

According to one method proposed, in order to supplement the cushioning property there is disposed a foam layer, which comprises a thermally decomposing foaming agent, foamable microcapsules, and the like, between the substrate (plain paper) and the receptor layer. This method, however, is associated with problems, for example, that the feel of the thermal transfer-receiving sheet is limited to a mat; that the manufacturing process is complicated and the manufacturing cost is high; and that a protective layer is necessary to protect the foam layer from a coating liquid which forms the receptor layer.

According to another method proposed, in order to supplement the cushioning property there is disposed a thermal insulation layer, which comprises fine resin particles, between the substrate (plain paper) and the receptor layer. This method, however, is associated with problems, for example, that the feel of the thermal transfer image receiving sheet is limited to a glossy; and that a protective layer is necessary to protect the thermal insulation layer of resin particles from a coating liquid which forms the receptor layer.

In these methods, the receptor layer is formed by applying a coating liquid to the substrate and thereafter drying the resulting layer. In contrast with these methods, Japanese Patent Application Laid-Open (JP-A) Nos. 8-112,974 and 8-224,970 propose a thermal transfer-receiving sheet comprising a plain paper having on the surface thereof a receptor layer made from a powdery coating composition containing a dyeable resin.

In the technique utilizing the powdery coating composition, a powdery coating composition is first prepared by a process comprising melt-blending a composition composed of a resinous substance, a white pigment, an electrification-controlling agent, an offset-preventing agent, and the like, cooling and pulverizing the melt-blended product, and classifying the resulting powder so that a product having an appropriate mean particle diameter is obtained. The powdery coating composition thus obtained is adhered as a layer to the surface of a sheet of plain paper or the like constituting a substrate by means of an electrostatic powder-coating method or the like, and the powder layer is then heated, pressed, or alternatively heated and pressed to fix the powder layer so that a dye receptor layer is formed. The thermal transfer-receiving sheet prepared in this way is advantageous in, for example, that the manufacturing process and the layer structure are simple and that the feel of a plain paper is not impaired.

When the substrate surface is coated with a powdery coating composition, even after the coated layer of the powdery coating composition is fixed by heating and/or pressing, the voids between powder particles do not perfectly disappear and some of the voids remain as pores. Therefore, the receptor layer formed is not a perfectly compact continuous layer, and minute pores and cracks are undesirably present inside the receptor layer. To the contrary, such undesirable phenomena do not occur if the receptor layer is formed by using a coating liquid. In addition, since the plain paper is a porous substrate, part of the powdery coating composition coated on the plain paper infiltrates into pores of pulp. The infiltration of the powdery composition into the pores of pulp is further promoted by the heating and pressing in the fixing process.

The above-described phenomenon makes it difficult to form a receptor layer having a constant thickness, because, even if a constant amount of the powdery composition is applied on the substrate surface, some pores are formed in the coated layer and part of the powdery composition infiltrates into the pores of pulp. Accordingly, the surface of the receptor layer thus obtained is markedly influenced by the surface irregularity of the plain paper constituting a substrate and tends to have such problems as lack of cushioning property and rough surface. As a result, it was difficult to obtain a printing sensitivity and an image quality of a satisfactory level.

In addition, if a single side of the plain paper constituting the substrate was provided with the receptor layer, the difference in shrinkage between the receptor layer and the substrate induced by heat or moisture led to defects such as curl in a printing process and environmental curl, thus presenting a significant impediment to the practical use of the plain paper as the substrate. Further, since the plain paper was used as the substrate, the heat delivered from the thermal head at the time of image printing caused dimensional change of the substrate to an extent that the image registration in printing sometimes deviated.

Yet another problem was that the scratch resistance of the receptor layer was so poor that it was difficult to write on the receptor layer with a pencil or the like.

SUMMARY OF THE INVENTION

A first object of the present invention is to provide excellent printing sensitivity and/or image quality to a thermal transfer-receiving sheet comprising a substrate made of a plain paper and a receptor layer disposed on the substrate, the receptor layer being formed by applying a powdery composition containing at least a dyeable resin on the substrate, by improving the cushioning property of the receptor layer.

A second object of the present invention is to provide excellent printing sensitivity and/or image quality to a thermal transfer-receiving sheet comprising a substrate made of a plain paper and a receptor layer disposed on the substrate, the receptor layer being formed by applying a powdery composition containing at least a dyeable resin on the substrate, by eliminating the roughness of the receptor layer surface.

A third object of the present invention is to provide excellent quality of printed image to a thermal transfer-receiving sheet comprising a substrate made of a plain paper and a receptor layer disposed on the substrate, the receptor layer being formed by applying a powdery composition containing at least a dyeable resin on the substrate, by preventing the curl in printing process, environmental curl or deviation of image registration in printing.

A fourth object of the present invention is to provide excellent writability (easiness to write) to a thermal transfer-receiving sheet comprising a substrate made of a plain paper and a receptor layer disposed on the substrate, the receptor layer being formed by applying a powdery composition containing at least a dyeable resin on the substrate, by improving the receptor layer.

A first aspect of the present invention enables to achieve at least the first object and the fourth object. The first aspect of the present invention is a thermal transfer-receiving sheet comprising a substrate made of a plain paper and a receptor layer disposed on the substrate, the receptor layer being formed by applying a powdery composition containing at least a dyeable resin on the substrate, wherein said receptor layer has a coated amount in a range of 6 $g/m^2$ or more and 22 $g/m^2$ or less. In order to improve image quality in printing, it is preferable that the receptor layer have an arithmetical mean deviation of profile (Ra) in a range of 1.2 $\mu$m or less. In order not to impair the feel of a plain paper, it is preferable that the receptor layer have a specular gloss of 45° (Gs(45°)) in a range of 10% or less. The curl in printing process, environmental curl or deviation of image registration in printing can be prevented and the third object of the present invention can be achieved together with the first object and the fourth object of the present invention either by disposing a back surface layer on the thermal transfer-receiving sheet or by adjusting the moisture content of the thermal transfer-receiving sheet within a range of 3.0 weight % or more and 8.0 weight % or less.

A second aspect of the present invention enables to achieve at least the first object. The second aspect of the present invention is a thermal transfer-receiving sheet comprising a substrate made of a plain paper and a receptor layer disposed on the substrate, the receptor layer being formed by applying a powdery composition containing at least a dyeable resin on the substrate, wherein the substantial thickness of the receptor layer defined by excluding a portion of the receptor layer infiltrating the substrate from the receptor layer is 7 $\mu$m or more. By setting the substantial thickness of the receptor layer to a value in a range of 7 $\mu$m or more and 30 $\mu$m or less, the fourth object can be achieved together with the first object. Also in the second aspect, it is preferable that the receptor layer have an arithmetical mean deviation of profile (Ra) in a range of 1.2 $\mu$m or less; and it is preferable that the receptor layer have a specular gloss of 45° (Gs(45°)) in a range of 10% or less. In addition, it is preferable to dispose a back surface layer on the thermal transfer-receiving sheet or to adjust the moisture content of the thermal transfer-receiving sheet within a range of 3.0 weight % or more and 8.0 weight % or less.

A third aspect of the present invention enables to achieve at least the second object. The third aspect of the present invention is a thermal transfer-receiving sheet comprising a substrate made of a plain paper and a receptor layer disposed on the substrate, the receptor layer being formed by applying a powdery composition containing at least a dyeable resin on the substrate, wherein a surface of said substrate made of a plain paper has physical properties in which a surface texture is in a range of 471 or less in terms of a roughness index; and a surface roughness is in a range of less than 2.1 $\mu$m in terms of an arithmetical mean deviation of profile (Ra), less than 23.2 $\mu$m in terms of a maximum height (Rmax) and less than 20.8 $\mu$m in terms of a mean roughness of ten points(Rz).

The thermal transfer-receiving sheet of the first aspect, the second aspect and the third aspect can be manufactured by a process comprising the steps of applying a powdery composition containing at least a dyeable resin on a substrate made of a plain paper to form a coated layer, and fixing the coated layer by heating and pressing while controlling the heating temperature, the applied pressure, the heating time and the pressing time to form a receptor layer.

The surface roughness and/or the specular gloss of the receptor layer of the thermal transfer-receiving sheet can be adjusted by a process comprising the steps of applying a powdery composition containing at least a dyeable resin on a substrate made of a plain paper to form a coated layer, and fixing the coated layer by means of a heating roll or a heating plate, whose surface roughness and/or the specular gloss is adjusted to a prescribed value, to form a receptor layer.

Further, in order to prevent curl in the printing process, environmental curl or deviation of image registration in printing, an anti-curl back surface layer may be formed by coating the back side of the thermal transfer-receiving sheet with an aqueous solution or an emulsion of a water-soluble resin or an emulsion of a polyvinylidene chloride resin. Furthermore, curl in the printing process, environmental curl or deviation of image registration in printing can be prevented during the manufacturing process of the thermal transfer-receiving sheet by spraying the thermal transfer-receiving sheet or an intermediate product thereof with steam to appropriately moisten the thermal transfer-receiving sheet or the intermediate product thereof.

DETAILED DESCRIPTION OF THE PREFERRED EMBODIMENTS

Figure 1:
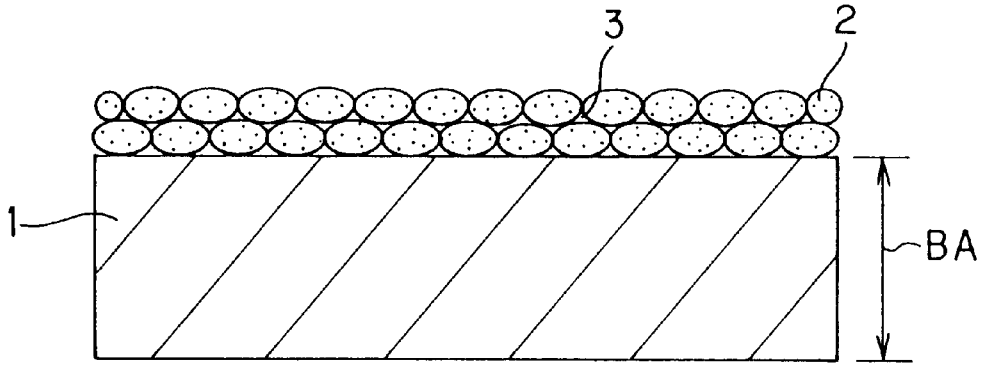
FIG. 1 is a view illustrating the process for manufacturing the thermal transfer-receiving sheet of the present invention.
Figure 2:
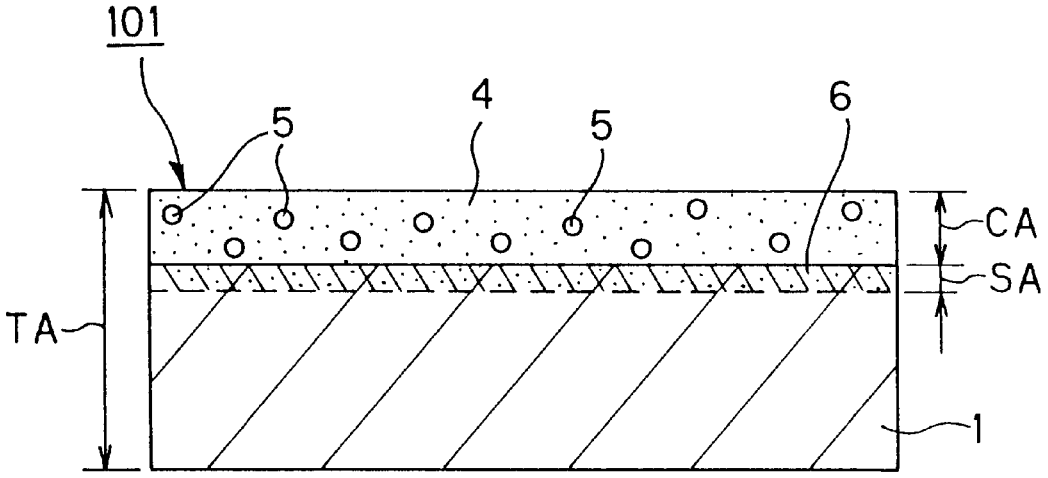
FIG. 2 is a schematic diagram illustrating the sectional view of one embodiment of the thermal transfer-receiving sheet of the present invention.

Now, preferred embodiments of a first aspect, a second aspect and a third aspect are described in detail with reference to the same drawings. When describing these aspects, the parts equally applicable to these aspects are given the same symbols. The thermal transfer-receiving sheet of the present invention can be manufactured by a process comprising the steps of applying a powdery composition containing at least a dyeable resin on a substrate 1 made of a plain paper to form a coated layer 2 as shown in FIG. 1, and fixing the coated layer 2 by such means as heating and pressing to the substrate to convert the coated layer 2 into a receptor layer 4 as shown in FIG. 2. Since the coated layer 2 before the fixing step is an aggregate of powder, voids are present inside the coated layer 2.

The structure of the thermal transfer-receiving sheet 101 thus obtained is described in detail with reference to FIG. 2. The voids inside the coated layer are not completely eliminated even after the fixing step, and therefore minute pores 5 and minute cracks which are not shown in FIG. 2 are present inside the receptor layer 4. Further, since part of the powdery coating composition infiltrates the substrate 1 made of a plain paper, a layer 6, which comprises a mixture of pulp and the resin for the receptor layer, is formed.

In the first aspect of the present invention, the coated amount calculated as solids of the receptor layer 4 is in a range of 6 $g/m^2$ or more and 22 $g/m^2$ or less. By setting the coated amount of the receptor layer to a value within this range, it is possible to exhibit an excellent printing performance without impairing the feel of the plain paper. If the coated amount of the receptor layer 4 is less than 6 $g/m^2$, the printing sensitivity is low and printing defects likely to occur are rough feel of the image, white void in the printed image, etc. On the other hand, a coated amount of the receptor layer 4 exceeding 22 $g/m^2$ is uneconomical, because further improvement in printing sensitivity and quality of printed image cannot be expected even if the coated amount is increased any further. If the coated amount is extremely large, possible disadvantage is that the fixation of the receptor layer is so poor that the scratch resistance when writing with a pencil is undesirably reduced.

In the second aspect of the present invention, the substantial thickness of the receptor layer 4 is 7 $\mu$m or more, and preferably in a range of 7 $\mu$m or more and 30 $\mu$m or less. If the thickness is 7 $\mu$m or more, the printing sensitivity and the quality of printed image are stabilized to an extent that the difference in performance of printed products is minimized. To the contrary, if the thickness is less than 7 $\mu$m, the printing sensitivity and the quality of printed image may not be satisfactory. On the other hand, a thickness exceeding 30 $\mu$m is uneconomical, because further improvement in printing sensitivity and quality of printed image cannot be expected even if the thickness is increased any further. If the receptor layer is extremely thick, possible disadvantage is that the fixation of the receptor layer is so poor that the scratch resistance when writing with a pencil is undesirably reduced.

The substantial thickness of the receptor layer 4 means the actual thickness of the receptor layer 4 after the fixing step thereof. In other words, the substantial thickness of the receptor layer 4 means the thickness which does not include the layer 6 composed of a mixture of pulp and the resin for the receptor layer, or alternatively the thickness of the receptor layer 4 which is clearly distinguished from the substrate 1.

Generally, where a solvent-based coating composition is applied on the surface of an impenetrable substance such as a plastic film to form a resin layer, the thickness of the resin layer can be obtained by the following equation 1 from the coated amount and the density without actually measuring the thickness, provided, however, that none of voids, cracks and the like are generated inside the resin layer and a continuous coating layer is produced simply by the evaporation of the solvent without the penetration of the coating composition into the substrate film:

[Equation 1]

Thickness ($\mu$m)=coated amount per unit area ($g/m^2$)/density of the composition ($g/cm^3$)

Where a powdery composition is applied, however, to the surface of a substrate 1 as shown in FIG. 1 and fixed by heating and pressing, the coated layer 2 from the powdery coating composition does not produce a perfectly continuous layer at the fixing step in which the particles of the powdery composition are melted to form the layer. Accordingly, as shown in FIG. 2, pores 5 and cracks, and the like are present inside the layer. Further, if a plain paper is used as the substrate, part of the coating composition penetrates into the voids of the pulp of the paper to thereby form a layer having a thickness corresponding to SA inside the paper. Therefore, since the thickness of the dye receptor layer produced from a powdery composition varies depending on such factors as the heating condition and the pressing condition at the time of fixing operation, kinds of the plain paper and kinds of the powdery composition, the thickness cannot be simply obtained by the equation 1 from the coated amount and the density of the coating composition.

The substantial thickness (CA) of the dye receptor layer is obtained by subtracting the thickness of the substrate (BA) from the total thickness (TA).

[Equation 2]

Thickness(CA) of coated layer ($\mu$m)=total thickness(TA) ($\mu$m)−thickness(BA) of the substrate ($\mu$m)

In the equation 2, both of the total thickness TA and the thickness of the substrate BA are actually measured values.

The present inventors have found that, where the receptor layer is made from a powdery composition, the substantial thickness(CA) of the receptor layer exerts a significant influence on the printing performances such as the quality of printed image and the printing sensitivity.

If the substantial thickness of the dye receptor layer 4 is less than 7 $\mu$m, the printing sensitivity and the quality of the printed image are not satisfactory, because the influence of the surface irregularity, which derives from the texture of the pulp of the plain paper serving as a substrate, is significant. To the contrary, if the thickness is 7 $\mu$m or more, both of the printing sensitivity and the quality of the printed image are satisfactory. Although the upper limit of the thickness cannot be specifically stipulated, the upper limit of the substantial thickness is preferably 30 $\mu$m, because a thickness more than necessary leads to higher costs.

The substantial thickness of the dye receptor layer can be obtained by actually measuring the thickness of the substrate made of a plain paper before coating and the thickness of the thermal transfer-receiving sheet after the formation of the dye receptor layer by the application of the powdery composition and fixing thereof. Even if the dye receptor layer is not continuous and has pores, cracks and the like formed therein, it works as expected if the thickness is 7 μm or more. The measures employed to attain a thickness of 7 μm or more include: 1) to apply the powdery composition at a coated amount of a certain value or more; 2) to control the amount of the powdery coating composition which penetrates into the plain paper by regulating the heating temperature and the pressure to be applied.

In the third aspect of the present invention, the thermal transfer-receiving sheet uses a substrate made of a plain paper having physical properties in which a surface texture is in a range of 471 or less in terms of a roughness index; and a surface roughness in accordance with JIS B 0601 is in a range of less than 2.1 μm in terms of an arithmetical mean deviation of profile (Ra), less than 23.2 μm in terms of a maximum height (Rmax) and unless than 20.8 μm in terms of a mean roughness of ten points(Rz).

If the roughness index of the surface of the plain paper is more than 471, the image formed by transfer has the feel of rough surface. The roughness index can be measured by a measuring apparatus "3-D SHEET ANALYSER M/K950" manufactured by M/K SYSTEMS Corp. Specifically, transmissivity of FLOC is measured and, as a result, the roughness index is obtained.

The value indicative of the surface texture is a value numerically indicating "roughness" which is one of the physical properties of the paper. Paper has a structure in which pulp fibers are entangled in a complicated manner. Therefore, when a sheet of paper is irradiated with light and the intensity of the transmitted light is measured, a region made up of densely packed pulp absorbs a larger amount of light to provide a lower intensity of transmitted light, whereas a region made up of loosely packed pulp absorbs a smaller amount of light to provide a higher intensity of transmitted light. Based on this principle, minute regions of paper are irradiated with light, and the intensity of the transmitted light is measured by scanning a measuring device over a certain area of the paper to obtain a numerical value indicative of "roughness", i.e., roughness index. Accordingly, the roughness index is a value indicative of the magnitude of the change of the intensity of the transmitted light and expresses "roughness". In the case of paper having a roughness index exceeding the above-mentioned value causes different levels of penetration of the powdery composition depending on the regions of paper, thus adversely affecting the quality of the printed image due to nonuniform formation of the dye receptor layer. To the contrary, in the case of paper having a small roughness index does not cause difference in penetration of the powdery composition depending on the regions of paper, thus providing a good printed image due to uniform formation of the dye receptor layer.

As to the surface roughness of the plain paper, an arithmetical mean deviation of profile (Ra) is less than 2.1 μm, a maximum height (Rmax) is less than 23.2 μm, and a mean roughness (Rz) of ten points is less than 20.8 μm. In the case of paper having the three values indicative of roughness larger than the above-mentioned respective values, good quality of image is not obtained due to rough surface of the image formed on the dye receptor layer. The surface roughness can be measured in accordance with JIS B 0601. The roughness of the plain paper needs to meets all of the requirements of the three values.

If the dye receptor layer is formed on a single side of the plain paper, the side of the plain paper on which the dye receptor layer is formed needs to have the above-mentioned physical properties. The dye receptor layer may be formed on both sides of the plain paper. If the dye receptor layer is formed on both sides of the plain paper, both sides of the plain paper need to meet the requirements of the surface physical properties, i.e., texture and roughness.

In every aspect of the present invention, it is desirable to appropriately adjust the surface roughness and/or specular gloss of the receptor layer.

As to the surface roughness of the receptor layer, an arithmetical mean deviation of profile (Ra), which is measured in accordance with JIS B 0601, is preferably 1.2 μm or less. If the roughness of the receptor layer exceeds this range, printing defects such as rough surface of image and white void occur.

In addition, in order for the thermal transfer-receiving sheet to exhibit the same feel as that of a plain paper, a specular gloss of 45° (Gs(45°)), which is defined in accordance with JIS Z 8741, is preferably 10% or less. If the specular gloss exceeds the range, the feel of the plain paper cannot be obtained because the feel of glossiness strongly appears on the receptor layer surface.

Effective as a method for adjusting the surface roughness and the specular gloss of the receptor layer is a method in which a fixing step is performed by means of a heating roll whose surface roughness and specular gloss are each adjusted in advance to a prescribed value.

The first aspect, the second aspect and the third aspect of the invention independently exhibit a specific effect of the invention. Further, if two or three of the aspects of the invention are combined together, an additive or synergistic effect can be obtained.

The details of the materials and the method for the preparation of the thermal transfer-receiving sheet of the present invention are described below.

[Substrate]

As the substrate, an ordinary paper composed essentially of pulp, i.e., a plain paper, is used. For example, usable are a fine-quality paper, an art paper, a lightweight coated paper, a slightly coated paper, a coated paper, a cast-coated paper, a synthetic resin- or emulsion-impregnated paper, a synthetic rubber latex-impregnated paper, a synthetic resin-lined paper, a thermal transfer paper and the like. The coated paper is obtained by coating a mixture, which is prepared by adding calcium carbonate, talc or the like to an SBR latex or the like, on a base paper. Among these papers, preferable are a fine-quality paper, a lightweight coated paper, a slightly coated paper, a coated paper, a thermal transfer paper and the like. Particularly preferable is an uncoated paper having pulp exposed to the surface thereof, because a powdery composition to form the dye receptor layer easily penetrates into such an uncoated paper and therefore the adhesion between the dye receptor layer and the uncoated paper is good.

Where the same paper as in various printings such as a gravure printing, an offset printing, a screen printing and the like is used as a substrate, it is possible to perform a trial printing by use of the thermal transfer-receiving sheet of the present invention without printing for proof reading. Accordingly, a printing plate for proof reading is not necessary.

The thickness of the substrate is usually in a range of 40 to 300 μm, and preferably in a range of 60 to 200 μm. In order for the thermal transfer-receiving sheet thus obtained to exhibit a feel of texture having a strong resemblance to that of a plain paper, a total thickness of the thermal transfer-receiving sheet is preferably in a range of 80 to 200 μm. The thickness of the substrate is the balance obtained by subtracting the sum (about 30 to 80 μm calculated as solids) of the thickness of the receptor layer and the thickness of the back surface layer to be formed on the substrate from the above-mentioned total thickness of the thermal transfer-receiving sheet.

[Receptor Layer]

The dye receptor layer is made from a powdery composition composed essentially of a dyeable resin. Besides the dyeable resin, the powdery composition may contain a release agent, which prevents the thermal fusion between the dye receptor layer and a thermal transfer sheet, an electrification-controlling agent for the powdery coating composition, a white pigment to impart screenability, an offset-preventing agent, a fluidizing agent and the like.

Examples of the dyeable resin include a saturated polyester resin, a polyamide resin, a polyacrylate resin, a polycarbonate resin, a polyurethane resin, a polyvinyl acetal resin, a polyvinyl chloride resin, a polyvinyl acetate resin, a polystyrene resin, a styrene/acrylic copolymer resin, a styrene/butadiene copolymer resin, a vinyl chloride/vinyl acetate copolymer resin, a vinyltoluene/acrylic copolymer resin, and a cellulosic resin. These resins may be used independently or in a combination of two or more. Preferably, the dyeable resin accounts for 70 weight % or more of the powdery composition. If the amount of the dyeable resin is less than 70 weight %, the dyeability is insufficient and the printing sensitivity may be low.

Examples of the release agent include a silicone oil, a plasticizer based on a phosphoric ester, a fluorine-containing compound, waxes and the like. Among these compounds, a silicone oil is preferred, because the silicone oil bleeds from the interior of the dye receptor layer after fixing thereof to the surface and easily forms a release layer on the surface. Preferable as the silicone oil are modified silicone oils such as epoxy-modified, alkyl-modified, amino-modified, carboxyl-modified, alcohol-modified, fluorine-modified, alkyl/aralkylpolyether-modified, epoxy/polyether-modified, polyether-modified or the like. Among these silicone oils, particularly preferred are a reaction product between a vinyl-modified silicone oil and a hydrogen-modified silicone oil; and a hardened product either between an amino-modified silicone and an epoxy-modified silicone, or between a modified silicone having active hydrogen and a hardener capable of reacting with the active hydrogen. Examples of the hardener having hydrogen are preferably non-after-yellowing isocyanate compounds, viz., XDI, hydrogenated XDI, TMXDI, HDI, IPDI, adduct/voilette forms thereof, oligomers thereof and prepolymers thereof. Preferred waxes are those having a melting point in a range of 50 to 150° C. and those exemplified by a fluid or solid paraffin, a polyolefinic wax such as polyethylene or polypropylene, a metal salt of fatty acid, an ester of fatty acid, a partially saponified ester of fatty acid, a higher fatty acid, a higher alcohol, a silicone varnish, an amide-based wax, an aliphatic fluorocarbon, and derivatives thereof The amount added of the release agent is preferably in a range of 0.2 to 30 parts by weight based on 100 parts by weight of the resin forming the dye receptor layer.

The electrification-controlling agent is intended for controlling the polarity of charge and the amount of charge of the powdery composition, and a conventionally known electrification-controlling agent for use in a toner for electrostatic latent image may be used for this purpose in the present invention. Examples of the electrification-controlling agent in terms of a negative polarity include a 2:1 type metal-containing azo dye, a metal complex of an aromatic hydroxy carboxylic acid or an aromatic dicarboxylic acid, a sulfonyl amine derivative of a copper phthalocyanine dye, and a sulfonamide derivative of a copper phthalocyanine dye. Examples of the electrification-controlling agent in terms of a positive polarity include a quaternary ammonium compound, an alkyl pyridinium compound, an alkyl picolinium compound, and a compound based on a nigrosine dye. The amount added of the electrification-controlling agent is preferably in a range of 0.1 to 10 parts by weight, more preferably in a range of 0.3 to 5 parts by weight, based on 100 parts by weight of the resin of the dye receptor layer.

The white pigment is intended for imparting screenability of a background or white color to the dye receptor layer. Examples of the white pigment include calcium carbonate, talc, kaolin, titanium oxide and zinc oxide. The amount added of the white pigment is preferably in a range of 10 to 200 parts by weight based on 100 parts by weight of the resin of the dye receptor layer. If the amount added of the white pigment is less than 10 parts by weight, the color adjusting effect is insufficient, whereas, if the amount added of the white pigment is more than 200 parts by weight, the dispersion stability of the white pigment in the dye receptor layer is so poor that the full performance of the resin in the dye receptor layer may not be exhibited.

The fluidity adjusting agent is intended for increasing the fluidity of the powdery composition, and examples of the fluidity adjusting agent include hydrophobic silica.

The powdery composition for the dye layer receptor may contain coloring materials such as a pigment, a dye and a fluorescent whitening agent. By appropriately incorporating these coloring materials in the powder composition, it is possible to produce a desired color when the color of the thermal transfer-receiving sheet needs to match that of a corresponding printing paper, if the thermal transfer-receiving sheet is used as a material for proof reading in trial printing.

A preferable color of the dye receptor layer, which is expressed in an L*a*b* color system, is within the following range:

$$85 \leqq L^* \quad -3 \leqq a^* \leqq 3 \quad -5 \leqq b^* \leqq 5$$

The color expressed in an L*a*b* color system can be measured by a method in accordance with JIS Z 8722 or JIS Z 8730. In the L*a*b* color system, L* represents a value such that the larger the number, the higher the value is. In the L*a*b* color system, a* represents a tinge of red such that the larger the number, the stronger the tinge of red is, and such that, if a* takes a negative value, a tinge of red is deficient and a tinge of green is stronger. In the L*a*b* color system, b* represents a tinge of yellow such that the larger the number, the stronger the tinge of yellow is, and such that, if b* takes a negative value, a tinge of yellow is deficient and a tinge of blue is stronger. If both of a* and b* are zero, a colorless state is expressed by the L*a*b* color system.

Since a sublimation type transfer recording method uses a dye, the color of the printed product is influenced by the color of the surface of the receptor layer. Although this influence can be avoided by correcting the energy applied according to the color of the thermal transfer-receiving sheet to be used at the time when the dye is transferred, the correction is difficult and a good visual feel of paper cannot be obtained if the color of the surface of the receptor layer is outside the above-mentioned range. In order to obtain the feel of a fine-quality paper, the following range is more preferable:

$$90 \leqq L^* - 1 \leqq a^* \leqq 1 - 2 \leqq b^* \leqq 3$$

In addition, it is preferable to use as a substrate a plain paper whose surface color is close to that of the thermal transfer-receiving sheet. This is because it may happen that the color of the substrate is seen through the receptor layer and therefore the surface color of the receptor layer is different from a desired color even if the color alone of the receptor layer, which is formed by the coating of a powdery composition and fixing thereof, is adjusted. The chrominance ΔE between the surface color of the substrate and a desired surface color of the receptor layer is preferably within the following equation:

$$\Delta E \leqq 3$$

The powdery coating composition of the receptor layer is prepared by a process comprising melt-blending a composition composed essentially of the dyeable resin, additives and the like, cooling and pulverizing the melt-blended product, and classifying the resulting powder so that a product having an appropriate mean particle diameter is obtained. The mean particle diameter of the powdery composition is preferably in a range of 1 to 30 μm, and more preferably in a range of 5 to 15 μm.

The powdery coating composition thus obtained is adhered as a layer to the surface of a substrate by a method that is described later, and the powder layer is then heated and/or pressed to fix the powder layer so that a dye receptor layer is formed.

[Back Surface Layer]

If a dye receptor layer is disposed on a single side of a substrate made of a plain paper, the thermal transfer sheet tends to curl. In particular, the difference in coefficients of thermal shrinkage and in dimensional change according to change of moisture content between the material for the dye receptor and the material for the substrate tends to cause curl at the time, for example, when heat is applied at a fixing step, when the surrounding temperature changes, or when humidity changes. In addition, the heat from a thermal head at the time of printing may change the moisture content of the thermal transfer-receiving sheet to cause dimensional change, and, as a result, a deviation in image registration in printing may occur. In order to solve these problems, a back surface layer can be formed on the back side, i.e., the side opposite to the side where the receptor layer is formed, of the substrate of the thermal transfer-receiving sheet.

The back surface layer may have the same composition as that of the dye receptor layer. It is also effective to apply a resin, such as polyvinylidene chloride, having a low permeability to steam as the back surface layer.

Further, the back surface layer may be composed essentially of a water soluble resin, such as polyvinyl alcohol, polyethylene glycol, or glycerin, having a good water retention.

Furthermore, in agreement with the conveyance system of the thermal transfer-receiving sheet of a printer, a back surface layer for imparting stiffness, a slipping property and the like may be disposed on back side, i.e., the side opposite to the side where the receptor layer is formed, of the substrate of the thermal transfer-receiving sheet. For the purpose of imparting a slipping property to the back surface layer, an inorganic or organic filler is dispersed in the resin of the back surface layer. A conventionally known resin or a blend of these resins may be used as a resin which imparts stiffness and a slipping property. In addition, the back surface layer may contain a slipping agent or a release agent such as a silicone.

The coated amount of the back surface layer is preferably in a range of 0.2 to 10 g/m$^2$. If the coated amount is less than this range, the performance of the back surface layer cannot be exhibited, whereas, if the coated amount is more than this range, the effect of the back surface layer is not improved any further and therefore uneconomical, and, in addition, the feel of a plain paper is adversely affected.

[Method for Manufacturing Thermal Transfer-Receiving Sheet]

(1) Coating process for a powdery composition

The method for manufacturing a thermal transfer-receiving sheet according to the present invention comprises the steps of applying the powdery composition composed essentially of a dyeable resin on a substrate made of a plain paper to form a coated layer, and fixing the coated layer by heating or pressing, or alternatively by heating and pressing. The use of the powdery composition is advantageous in that the wastage of the coating composition is slight and in that the non-solvent composition minimizes environmental pollution. Examples of the method for coating the powdery composition include the coating method in electrophotography and the coating method in electrostatic coating of a powder.

(1)-a: Coating according to Electrophotography

The method according to electrophotography is based on the same principle as in an electrophotographic copying and laser printing. The particles of a powdery coating composition(toner) undergo frictional charging or the like and the particles thus charged are adhered to the surface of a drum which has charge of opposite polarity by an electrostatic attraction. The toner particles on the surface of the drum are transferred to a substrate made of a plain paper, and the particles are heated to be fixed. Since the drum is made of an organic photoconductor, the drum can be electrified by, for example, corona charging. For the purpose of partial electrification, the portions of the drum surface corresponding to a desired image may be irradiated with light to selectively eliminate the charge to form a so-called electrostatic latent image, and a powdery composition is adhered in accordance with a pattern of the latent image thus formed. The powdery composition on the latent image may be transferred, and the transferred pattern is fixed to form a dye receptor layer selectively on desired portions.

The method according to electrophotography has the following advantages. That is, since an apparatus for use in this method has many parts basically in common with a copying machine, the apparatus can be downsized. It is basically possible to incorporate the apparatus in a thermal transfer printer. Further, since a partial coating is possible so that the receptor layer can be formed selectively on the desired portions of the transfer-receiving substrate, the wastage of the powdery coating composition can be eliminated.

Furthermore, if the powdery coating composition is coated on the entire surface of the transfer-receiving substrate, the electrostatic latent image-forming mechanism may be eliminated from the coating apparatus and the coating apparatus may have a simplified mechanism, i.e., charging of drum—electrification of powdery composition—transfer—fixing—elimination of the charge of drum—cleaning of drum.

On the other hand, the method according to electrophotography has the following disadvantages. That is, since the transfer of the powdery composition from the drum to the transfer-receiving substrate is not perfect and some of the powdery composition remains on the drum. Although the remaining powdery composition is removed from the drum by means of a cleaning mechanism, the removed powdery composition constitutes a wastage if it is discarded as a waste. Although the removed powdery composition may be recovered to be mixed with a fresh powdery composition for recycling, the mechanism for this purpose is complicated to an extent that the aforementioned advantage of downsizing and simplification of the coating apparatus is reduced. This disadvantage can be understood by the currently available transfer efficiency of about 80 to 85%.

The smoothness of the drum surface and uniform electrification thereof are very important for the elimination of unevenness in the coated amount and defects in coating. However, these conditions cannot be perfectly realized, because, if a surface area exceeds a certain size, it is difficult to electrify the area perfectly uniformly. Therefore, it is difficult to industrially manufacture a thermal transfer-receiving sheet having a constant quality.

When weight is attached to the downsizing of the apparatus, the highest speed attainable for the process from coating to fixing will be that of a copying machine.

(1)-b: Electrostatic Powder Coating

In the method according to electrostatic powder coating, charged particles of a powdery coating composition are sprayed by use of an electrostatic spray gun to the surface of a plain paper which is grounded so as to adhere the particles of the powdery composition to the surface of the plain paper by electrostatic attraction. The powder composition is fed to the vicinity of the electrostatic spray gun tip by means of air stream, and is electrified by means of a needle-like or ring-like corona charging electrode which is disposed in the vicinity of the gun tip and to which a potential of −20~80 kV is impressed, and leaves the gun to be sprayed to the surface of the plain paper. Meanwhile, it is also possible to generate electrostatic charge on the particles of a powdery composition by stirring the particles in a container through the friction of the particles against the inner wall of the container. The powdery composition adhering to the surface of the plain paper is converted into a receptor layer by thermally fusing the composition by, for example, infrared and applying, if necessary, pressure. For the purpose of fixing the receptor layer, either heat or pressure is applied, or alternatively both heat and pressure are applied. A powdery coating composition, which contains a thermosetting resin and which is hardenable by baking, can also be used.

The method according to electrostatic powder coating has the following advantages. That is, since the powdery coating composition is uniformly electrified by means of an electrostatic spray gun, a coated layer, which is uniform and free from defects in coating, can be obtained. Further, since coated amount can be accurately controlled by amount of the composition ejected from the electrostatic spray gun and by the moving speed of the gun in relation to the object to be coated, it is easy to industrially manufacture a thermal transfer-receiving sheet having a constant quality.

Although, as in the case of the electrophotographic method, it is impossible to adhere all of the powdery composition to the object to be coated, a coating efficiency of 95% or more can be realized by the recovery and the recycling of the powdery coating composition. Supposing this method is for industrial production, the advantage that the wastage of the coating composition can be minimized is attractive even if the recovery system becomes somewhat larger.

On the other hand, the method according to electrostatic powder coating has the following disadvantages. That is, since charged, minute particles of the powdery coating composition are sprayed onto the object to be coated, a measure needs to be taken against the scattering of the particles. Therefore, the apparatus for coating is so large-sized that it cannot be incorporated in the printer unlike the case of the electrophotographic method.

Further, it is impossible to apply the coating composition selectively to a desired portion of the object to be coated. For example, masking of the object by an appropriate means is necessary.

Although any of the foregoing methods is applicable in the present invention, the method according to electrostatic powder coating is preferable in the case where the thermal transfer-receiving sheet is industrially manufactured in a continuous process.

(2) Fixing Process of Powdery Coating Composition

According to the foregoing methods, a powdery composition containing at least a dyeable resin is coated on a substrate made of a plain paper to form a coated layer, and the coated layer is fixed by heating and/or or pressing to form a receptor layer. Examples of the heating means include indirect heating by hot air, infrared, microwave or the like and direct heating by a roll or a plate. Examples of the pressing means include a roll and a plate.

In the method for manufacturing the thermal transfer-receiving sheet, for the purpose of adjusting an arithmetical mean deviation of profile (Ra) within a range of 1.2 $\mu$m or less and adjusting a specular gloss of 45° (Gs(45°)) within a range of 10% or less, it is effective to adjust the surface roughness and the specular gloss of the heating roll or plate in advance to prescribed values.

Figure 3:
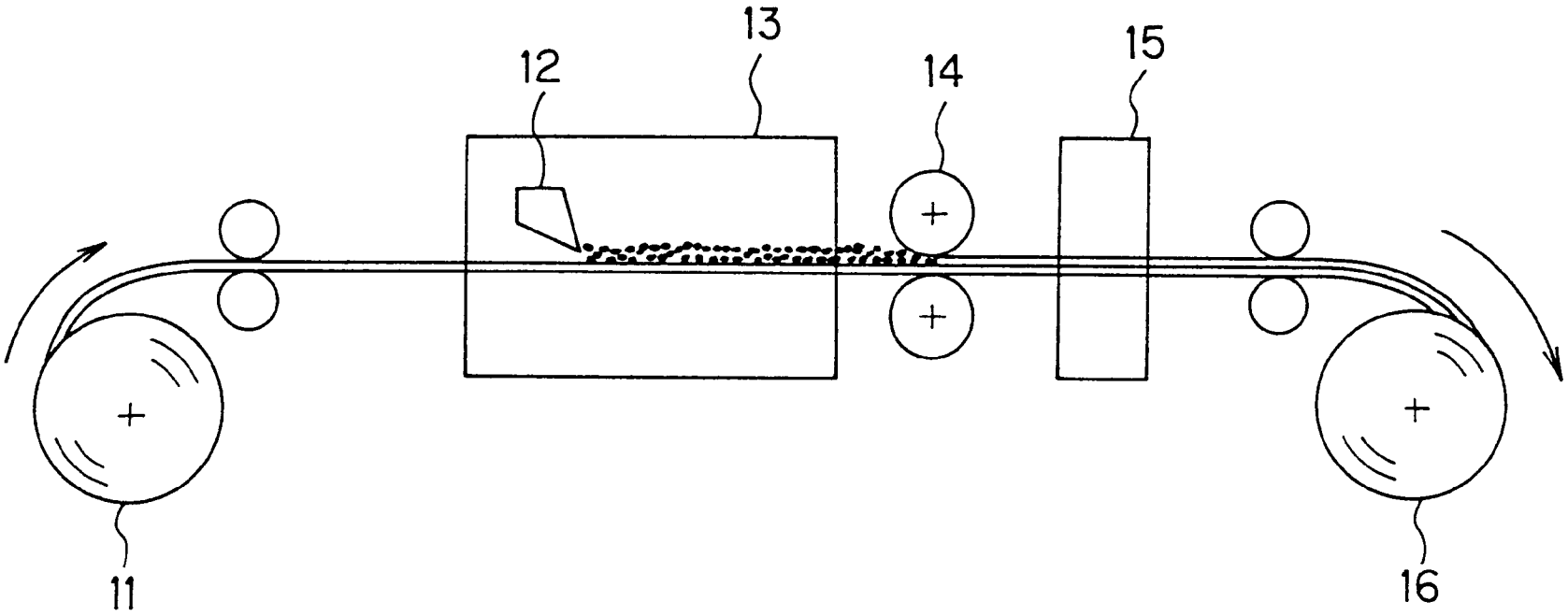
FIG. 3 is a schematic diagram illustrating an example of the apparatus to manufacture the thermal transfer-receiving sheet of the present invention.

For example, as shown in FIG. 3, a manufacturing apparatus comprises an electrostatic coating device 13, which is designed for coating a powdery composition on a surface of a plain paper and which comprises a roll 11 for feeding the plain paper and a hand gun 12, etc., a fixing device 14, which comprises a pressing roll and a heating roll, a cooling device 15, and a winding device 16 which winds up the thermal transfer-receiving sheet.

(3) Adjustment of Coated Weight or Thickness of Receptor Layer

In the present invention, it is preferable to adjust the coated amount of the receptor layer in a range of 6 to 22 g/m$^2$, or to adjust the thickness of the receptor layer in a range of 7 to 30 $\mu$m.

The coated amount of the receptor layer is adjusted by taking into account the loss of the powdery composition in the coating process.

The thickness of the receptor layer varies depending on the coated amount. Further, the thickness of the receptor layer varies depending on such factors as the amount of the powdery composition which penetrates into the substrate when the powdery composition melts and the proportion of voids in the powdery coating composition. Accordingly, when the thickness of the receptor layer is adjusted, the heating temperature, the pressure to be applied and the like are also adjusted together with the coated amount according to such factors as the kind and the density of the powdery coating composition and the kind of the plain paper constituting the substrate.

(4) Adjustment of Moisture Content of Thermal Transfer-Receiving Sheet

In order to prevent the curl due to environmental humidity, it is preferable to control the moisture content of the thermal transfer-receiving sheet within a range of 3.0 weight % or more and 8.0 weight % or less. If the moisture content is less than this range, curling occurs in an environment of high humidity, whereas, if the moisture content is more than this range, curling occurs in an environment of low humidity. For the purpose of controlling the moisture content within the range, the thermal transfer-receiving sheet may be sprayed with steam to appropriately moisten it, or the back side of the thermal transfer-receiving sheet may be coated with water, an aqueous solution of a water soluble resin, such as polyvinyl alcohol, polyethylene glycol or the like, or an emulsion of a polyvinylidene chloride resin.

(5) Process for forming Back Surface Layer

Since one of the advantages of the present invention is that the receptor layer is formed on a substrate made of a plain paper by coating a powdery composition on the substrate without using a solvent, it is also desirable to form the back surface layer by coating a powdery composition on the substrate without using a solvent.

Accordingly, the methods for forming the back surface layer are roughly divided into two, viz., an electrophotographic method and an electrostatic powder coating method. The back surface layer can be formed by a process comprising coating the back side with a powdery coating composition containing at least a resin, and heating and/or pressing the resulting layer. Examples of the heating means include indirect heating by hot air, infrared, microwave or the like and direct heating by a roll or a plate. Examples of the pressing means include a roll and a plate.

However, in the case where a coating method by use of a powdery coating composition cannot be adopted in the formation of the back surface layer, or in the case where sufficient chargeability or fluidity cannot be imparted to a resin, a coating solution comprising a solution of the resin in an organic solvent may be used.

[Method for Thermal Transfer]

When a thermal transfer-receiving sheet is used, a thermal transfer sheet, which is a sublimation type thermal transfer sheet for use in sublimation type transfer recording, is used. For the purpose of providing thermal energy for the thermal transfer, a known means can be used. For example, an image can be formed by providing thermal energy in a range of about 5 to 100 mJ/mm$^2$ through the control of the recording time by a recording apparatus such as a thermal printer (e.g., RAINBOW M2720 manufactured by 3M Corp.).

EXAMPLES

Details of the present invention are explained below by way of examples and comparative examples.

Examples of A series

[Example A-1]

The raw materials listed below were mixed by a mixer. The mixture was melted by heating and was then melt-blended by a melt-blending machine. After the blend solidified by cooling, the product was pulverized and the resulting powder was classified. In this way, a powdery composition having a mean particle diameter of 8 $\mu$m was obtained. 100 parts by weight of this powdery composition was admixed with 2 parts by weight of hydrophobic silica (RA-200H manufactured by Nippon Aerosil Co., Ltd.) to obtain a powdery coating composition.

<Materials for Powdery Coating Composition to form Receptor Layer>

Polyester resin (DIACLON FC-611 manufactured by Mitsubishi Rayon Co., Ltd.): 80 parts by weight Styrene/acrylic resin (FB-206 manufactured by Mitsubishi Rayon Co., Ltd.): 20 parts by weight Electrification-controlling agent (VONTRON P-51 manufactured by Orient Industry Co., Ltd.): 4 parts by weight Titanium oxide (TCA 888 manufactured by Tochem Products Co., Ltd.): 2 parts by weight Amino-modified silicone (X22-349 manufactured by Shin-Etsu Chemical Co., Ltd.): 1 part by weight Epoxy-modified silicone (KF-393 manufactured by Shin-Etsu Chemical Co., Ltd.): 1 part by weight The composition to form a receptor layer was applied on the surface of one side of a fine-quality paper which served as a substrate and had a basis weight of 104.7 g/m$^2$ at a coated weight of 9 g/m$^2$ (based on solids) by means of an electrostatic powder-coating apparatus and a hand gun described below. The coated layer was fixed by heating and pressing by means of a heating roll in the conditions indicated below to form a dye receptor layer, and thus a thermal transfer-receiving sheet was prepared.

<Coating Apparatus>

Electrostatic powder-coating apparatus: GX5000S manufactured by Nihon Parkerizing Co., Ltd.

Hand gun: GX106N manufactured by Nihon Parkerizing Co., Ltd.

<Conditions for Fixing Process>

Diameter of heating rolls: 40 mm both for receptor layer and back surface layer

Heating temperature: 140° C. for both rolls

Speed of roll: 20 mm/min.

Pressure applied: 2 kg/25 cm of roll length

Surface roughness of roll (Ra): 0.5 $\mu$m for both rolls

Specular gloss of roll (Gs(45°)): 8.0%

[Example A-2]

A polyvinylidene chloride emulsion (SARAN LATICES L536B containing solids of 50% by weight manufactured by Asahi Chemical Industry) was applied on the side opposite to the side having the receptor layer of the substrate of the thermal transfer-receiving sheet of Example A-1 at a coated weight of 5 g/m$^2$ (based on solids) by means of gravure coating and the coated layer was dried by means of hot air blow. In this way, a thermal transfer-receiving sheet was obtained.

[Example A-3]

A thermal transfer-receiving sheet was obtained by repeating the procedure of Example A-2, except that the coated weight of the powdery composition for the receptor layer was 7 g/m$^2$ (based on solids).

[Example A-4]

A thermal transfer-receiving sheet was obtained by repeating the procedure of Example A-2, except that the coated weight of the powdery composition for the receptor layer was 20 g/m$^2$ (based on solids).

[Example A-5]

A thermal transfer-receiving sheet was obtained by repeating the procedure of Example A-2, except that surface roughness of roll (Ra) was 0.8 μm and specular gloss of roll (Gs45°) was 6% for both rolls used for thermally fixing the receptor layer.

[Example A-6]

A thermal transfer-receiving sheet was obtained by repeating the procedure of Example A-2, except that the application of the polyvinylidene chloride emulsion was replaced with the spraying of steam on the side opposite to the side having the receptor layer of the substrate.

[Comparative Example a-1]

A thermal transfer-receiving sheet was obtained by repeating the procedure of Example A-1, except that the coated weight of the powdery composition for the receptor layer was 4 g/m$^2$ (based on solids).

[Comparative Example a-2]

A thermal transfer-receiving sheet was obtained by repeating the procedure of Example A-1, except that the coated weight of the powdery composition for the receptor layer was 25 g/m$^2$ (based on solids).

[Comparative Example a-3]

A thermal transfer-receiving sheet was obtained by repeating the procedure of Example A-1, except that surface roughness of roll (Ra) was 2.0 μm and specular gloss of roll (Gs45°) was 3% for both rolls used for thermally fixing the receptor layer.

[Comparative Example a-4]

A thermal transfer-receiving sheet was obtained by repeating the procedure of Example A-1, except that surface roughness of roll (Ra) was 0.4 μm and specular gloss of roll (Gs45°) was 30% for both rolls used for thermally fixing the receptor layer.

Table 1 below shows the coated weight of the receptor layer, the surface roughness (Ra) of the receptor layer, the specular gloss (Gs45°) of the receptor layer, the moisture content measured of the thermal transfer-receiving sheet, and the presence or absence of the back surface layer for each of the thermal transfer-receiving sheets prepared in the foregoing examples and comparative examples.

TABLE 1

| | Coated Weight of Receptor Layer (g/m2) | Surface Roughness of Receptor Layer: Ra (μm) | Specular Gloss of Receptor Layer: Gs45° (%) | Moisture Content (%) | Presence or Absence of Back Surface Layer |
|---|---|---|---|---|---|
| | | | Examples | | |
| A-1 | 9 | 0.8 | 5.0 | 2.2 | absent |
| A-2 | 9 | 0.8 | 5.0 | 4.0 | present *1 |
| A-3 | 7 | 0.8 | 4.8 | 4.0 | present *1 |
| A-4 | 20 | 0.8 | 4.6 | 4.0 | present *1 |

TABLE 1-continued

| | Coated Weight of Receptor Layer (g/m2) | Surface Roughness of Receptor Layer: Ra (μm) | Specular Gloss of Receptor Layer: Gs45° (%) | Moisture Content (%) | Presence or Absence of Back Surface Layer |
|---|---|---|---|---|---|
| A-5 | 9 | 1.1 | 3.5 | 4.0 | present *1 |
| A-6 | 9 | 0.8 | 4.8 | 4.5 | absent *2 |
| | | | Comparative Examples | | |
| a-1 | 4 | 1.2 | 4.6 | 2.4 | absent |
| a-2 | 25 | 0.9 | 4.8 | 2.0 | absent |
| a-3 | 9 | 1.5 | 3.3 | 2.2 | absent |
| a-4 | 9 | 0.5 | 18 | 2.4 | absent |

*1 denotes the presence of a back surface layer formed by the application of a polyvinylidene chloride emulsion.
*2 denotes the absence of a back surface layer, but spraying the back side with steam instead.

<Methods for Evaluation>

The thermal transfer-receiving sheets of the examples and the comparative examples were evaluated in terms of scratch resistance, resistance to environmental curl, and feel.

The thermal transfer-receiving sheets of the examples and the comparative examples were subjected to a printing test by use of a sublimation type transfer printer, viz., RAINBOW M2720 manufactured by 3M Corp., and a dye-transfer film designed for use in the printer. The quality of printed images, printing sensitivity and image registration in printing (deviation of printed images) were evaluated in the printing test. Evaluation methods are described below.

(1) Quality of printed images

A black (Bk) single-color solid image of low density (25%/100%), Bk single-color (100%/100%) fine lines of 1 dot and 2 dots, and a Bk single-color (100%/100%) letter-image were formed and subjected to evaluation in terms of printing performance and quality of images. The quality of images was visually inspected.

Criteria were as follows:

○: good without any print void, blur of fine lines or the like

Δ: somewhat observable print void and blur of fine lines

X: conspicuous print void and blue of fine lines (2) Printing sensitivity

A magenta (Mg) single-color solid image (70%/100%) was prepared and was subjected to the evaluation in terms of printing performance and printing sensitivity. The sensitivity was measured by GRETAG SPM50.

Criteria were as follows:

○: OD value of 0.9 or more

Δ: OD value of 0.8 or more and less than 0.9

X: OD value of less than 0.8

(3) Image registration in printing

For this test there was used a sheet in A4 size having a 25×17 cm YMCK black solid image whose four corners each had a cross mark for the purpose of the inspection of the deviation of registration. In the test, the lengths (mm) of deviation of each cross mark in longitudinal direction and transverse direction were measured. The sum of the absolute values of the length (mm) of deviation of the four cross marks in longitudinal direction and transverse direction was calculated and evaluated according to the following criteria:

○: less than 0.5 mm

Δ: 0.5 mm or more and less than 1.0 mm

X: 1.0 mm or more (4) Scratch resistance

Letters were written with an HB pencil on the surface of receptor layer of a thermal transfer-receiving sheet, and the degree of damage was visually inspected.

Criteria were as follows:

○: good without any surface scratch mark, scrape or the like

Δ: somewhat observable surface scratch mark, scrape or the like

X: conspicuous surface scratch mark, scrape or the like (5) Curl

A thermal transfer-receiving sheet was placed in an environment of 25° C. and 50% RH for 24 hours, and thereafter a square sheet of 10×10 cm was cut out of the thermal transfer-receiving sheet. The square sheet was placed on a flat plate with the receptor layer facing upward, and the heights of the four corners from the plate were measured. Next, the square sheet was placed in an environment of 40° C. and 90% RH for 5 hours, and thereafter and the heights of the four corners from a flat plate were measured. Based on these values, an average of the differences (absolute values) of the heights of the four corners were calculated, and the average thus obtained was defined as a curl height. The same test was repeated, except that the square sheet was placed with the receptor layer facing downward. Further, all of the foregoing tests were repeated, except that the square sheet was placed in an environment of 10° C. and 15% RH instead of the environment of 40° C. and 90% RH.

Criteria were as follows:

○: curl height of less than 10 mm

Δ: curl height of 10 mm or more and less than 20 mm

X: curl height of more than 20 mm (6) Feel

Each thermal transfer-receiving sheet obtained was visually inspected in terms of the feel of a plain paper.

Criteria were as follows:

○: like a plain paper with a natural mat feel

X: unlike a plain paper with insufficient mat feel

The results are shown in Table 2.

TABLE 2

| | Quality of Printed Image | Printing Sensitivity | Image Registration in Printing | Scratch Resistance | Curl | Feel |
|---|---|---|---|---|---|---|
| | | | Examples | | | |
| A-1 | ○ | ○ | X | ○ | X | ○ |
| A-2 | ○ | ○ | ○ | ○ | ○ | ○ |
| A-3 | ○ | ○ | ○ | ○ | ○ | ○ |
| A-4 | ○ | ○ | X | ○ | ○ | ○ |
| A-5 | ○ | ○ | ○ | ○ | X | ○ |
| A-6 | ○ | ○ | Δ | ○ | ○ | ○ |
| | | | Comparative Examples | | | |
| a-1 | X | X | X | Δ | X | ○ |
| a-2 | ○ | ○ | X | X | X | ○ |
| a-3 | Δ | X | X | ○ | X | ○ |
| a-4 | ○ | ○ | X | ○ | X | X |

Examples of B series

[Example B-1]

The raw materials listed below were mixed by a mixer. The mixture was melted by heating and melt-blended by a melt-blending machine. After the blend solidified by cooling, the product was pulverized and the resulting powder was classified. In this way, a powdery composition having a mean particle diameter of 8 μm was obtained. 100 parts by weight of this powdery composition was admixed with 2 parts by weight of hydrophobic silica (RA-200H manufactured by Nippon Aerosil Co., Ltd.) to obtain a powdery coating composition for a dye receptor layer.

<Materials for Powdery Coating Composition to form Receptor layer>

Polyester resin (DIACLON FC-611 manufactured by Mitsubishi Rayon Co., Ltd.): 80 parts by weight Styrene/acrylic resin (FB-206 manufactured by Mitsubishi Rayon Co., Ltd.): 20 parts by weight Electrification-controlling agent (VONTRON P-51 manufactured by Orient Industry Co., Ltd.): 4 parts by weight Titanium oxide (TCA 888 manufactured by Tochem Products Co., Ltd.): 2 parts by weight Amino-modified silicone (X22-349 manufactured by Shin-Etsu Chemical Co., Ltd.): 1 part by weight Epoxy-modified silicone (KF-393 manufactured by Shin-Etsu Chemical Co., Ltd.): 1 part by weight Next, the composition to form a receptor layer was applied on the surface of one side of a fine-quality paper which served as a substrate and had a basis weight of 104.7 $g/m^2$ at a coated weight of 10 $g/m^2$ (based on solids) by means of a coating apparatus described below. The coated layer was fixed by heating and pressing by means of a heating roll in the conditions indicated below to form a dye receptor layer, and thus a thermal transfer-receiving sheet was obtained. The thickness of the fine-quality paper was measured by a meter (μ Mate manufactured by Sony Corp.) and was found to be 93 μm.

<Coating Apparatus>

Electrostatic powder-coating apparatus: GX5000S manufactured by Nihon Parkerizing Co., Ltd.)

Hand gun: GX106N manufactured by Nihon Parkerizing Co., Ltd.

<Conditions for Fixing Process>

Diameter of heating rolls: 40 mm both for receptor layer and back surface layer

Heating temperature: 140° C. for both rolls

Speed of roll: 20 mm/min.

Pressure applied: 2 kg/25 cm of roll length

Surface roughness of roll (Ra): 0.5 μm for both rolls

Specular gloss of roll (Gs(45°)): 8.0%

[Examples B-2~B-6 and Comparative Examples b-1~b-3]

Thermal transfer-receiving sheets were obtained by repeating the procedure of Example B-1, except that the coated weights of the powdery composition for the receptor layer and fixing conditions were those shown in Table 3.

The thickness of each of the dye receptor layers was measured by measuring the total thicknesses of the thermal transfer-receiving sheets of the examples and the comparative examples. In addition, the thermal transfer-receiving sheets of the examples and the comparative examples were subjected to a printing test by use of a sublimation type transfer printer, viz., RAINBOW M2720 manufactured by 3M Corp., and a dye-transfer film designed for use in the printer. The quality of printed images and printing sensitivity were evaluated in the printing test. The results of the measurements and evaluations are shown in Table 3. Evaluation methods are described below.

(1) Quality of printed images

A black (Bk) single-color solid image of low density (25%/100%), Bk single-color (100%/100%) fine lines of 1 dot and 2 dots, and a Bk single-color (100%/100%) letter-image were formed and subjected to evaluation in terms of printing performance and quality of images. The quality of images was visually inspected.

Criteria were as follows:

○: good without any print void, blur of fine lines or the like

Δ: somewhat observable print void and blur of fine lines

X: conspicuous print void and blue of fine lines (2) Printing sensitivity

A magenta (Mg) single-color solid image (70%/100%) was prepared and subjected to evaluation in terms of printing performance and printing sensitivity. The sensitivity was measured by GRETAG SPM50.

Criteria were as follows:

○: OD value of 0.9 or more

Δ: OD value of 0.8 or more and less than 0.9

X: OD value of less than 0.8

TABLE 3

| | Coated Amount of Receptor Layer (g/m2) | Fixing Condition *3 Temperature (° C.) | Fixing Condition *3 Roll Speed (mm/min) | Thickness of Coated Layer (μm) | Quality of Printed Image | Printing Sensitivity |
|---|---|---|---|---|---|---|
| | | | Examples | | | |
| B-1 | 10 | 140 | 20 | 10 | ○ | ○ |
| B-2 | 13 | 140 | 20 | 12 | ○ | ○ |
| B-3 | 16 | 140 | 20 | 16 | ○ | ○ |
| B-4 | 10 | 160 | 20 | 9 | ○ | ○ |
| B-5 | 10 | 170 | 20 | 8 | ○ | ○ |
| B-6 | 10 | 180 | 20 | 7 | ○–Δ | ○ |
| | | | Comparative Examples | | | |
| b-1 | 6 | 140 | 20 | 5 | X | X |
| b-2 | 10 | 200 | 20 | 6 | Δ–X | X |
| b-3 | 10 | 140 | 5 | 6 | Δ–X | X |

*3 Temperatures denote the temperature of upper roll and lower roll. Both rolls had the same temperature as shown in the table.

Examples of C series

[Example C-1]

The raw materials listed below were mixed by a mixer. The mixture was melted by heating and melt-blended by a melt-blending machine. After the blend solidified by cooling, the product was pulverized and the resulting powder was classified. In this way, a powdery composition having a mean particle diameter of 8 μm was obtained. 100 parts by weight of this powdery composition was admixed with 2 parts by weight of hydrophobic silica (RA-200H manufactured by Nippon Aerosil Co., Ltd.) to obtain a powdery coating composition for a dye receptor layer.

<Materials for Powdery Coating Composition to form Receptor layer>

Polyester resin (DIACLON FC-611 manufactured by Mitsubishi Rayon Co., Ltd.): 80 parts by weight Styrene/acrylic resin (FB-206 manufactured by Mitsubishi Rayon Co., Ltd.): 20 parts by weight Electrification-controlling agent (VONTRON P-51 manufactured by Orient Industry Co., Ltd.): 4 parts by weight Titanium oxide (TCA 888 manufactured by Tochem Products Co., Ltd): 2 parts by weight Amino-modified silicone (X22-349 manufactured by Shin-Etsu Chemical Co., Ltd.): 1 part by weight Epoxy-modified silicone (KF-393 manufactured by Shin-Etsu Chemical Co., Ltd.): 1 part by weight The substrate for this series of examples was made of a plain paper having physical properties in which a surface texture was 471 in terms of a roughness index; and a surface roughness was 1.8 μm in terms of an arithmetical mean deviation of profile (Ra), 20.8 μm in terms of a maximum height (Rmax) and 19.6 μm in terms of a mean roughness of ten points(Rz). The composition to form a receptor layer was applied on the surface of one side of the substrate at a coated weight of 10 g/m$^2$ (based on solids) by means of a coating apparatus described below. The coated layer was fixed by heating and pressing by means of a heating roll in the conditions indicated below to form a dye receptor layer, and thus a thermal transfer-receiving sheet was obtained.

<Coating Apparatus>

Electrostatic powder-coating apparatus: GX5000S manufactured by Nihon Parkerizing Co., Ltd.

Hand gun: GX106N manufactured by Nihon Parkerizing Co., Ltd.

<Conditions for Fixing Process>

Diameter of heating rolls: 40 mm both for receptor layer and back surface layer

Heating temperature: 140° C. for both rolls

Speed of roll: 20 mm/min.

Pressure applied: 2 kg/25 cm of roll length

Surface roughness of roll (Ra): 0.5 μm for both rolls

Specular gloss of roll (Gs(45°)): 8.0%

[Examples C-2~C-3 and Comparative Examples c-1~c-6]

Thermal transfer-receiving sheets were obtained by repeating the procedure of Example C-1, except that plain papers each having the texture and roughness shown in Table 4 were used.

The thermal transfer-receiving sheets of the examples and the comparative examples were subjected to a printing test by use of a sublimation type transfer printer, viz., RAINBOW M2720 manufactured by 3M Corp., and a dye-transfer film designed for use in the printer. Then, quality of printed images was visually evaluated. The results of evaluation are shown in Table 4. The evaluation was performed by visual inspection, and an image having a smooth surface and good quality was rated as ○, while an image having a rough surface and poor quality was rated as X.

TABLE 4

| | Surface Properties of Plain Paper | | | | |
|---|---|---|---|---|---|
| | Texture *4 | Surface Roughness (μm) | | | Ratings of |
| | (Roughness Index) | Ra | Rmax | Rz | Printed Image |
| | | Examples | | | |
| C-1 | 471 | 1.8 | 20.8 | 19.6 | ○ |
| C-2 | 469 | 2.0 | 22.9 | 20.6 | ○ |
| C-3 | 434 | 1.3 | 18.9 | 16.9 | ○ |
| | | Comparative Examples | | | |
| c-1 | 551 | 2.1 | 23.2 | 20.8 | X |
| c-2 | 549 | 2.3 | 28.0 | 26.2 | X |
| c-3 | 511 | 2.6 | 29.6 | 26.2 | X |
| c-4 | 509 | 2.1 | 25.5 | 23.7 | X |
| c-5 | 506 | 2.0 | 24.4 | 22.6 | X |
| c-6 | 474 | 2.1 | 28.3 | 21.2 | X |

*4 Texture was measured by means of 3-D SHEET ANALYZER M/K950 manufactured by M/K SYSTEMS Corp. in U.S.A. The measurement was based on transmission in a condition of sensitivity: RANGE 1(standard sensitivity), and an opening: 1.5 mm.

What is claimed is:

1. A thermal transfer-receiving sheet comprising a substrate made of a plain paper and a receptor layer disposed on the substrate, the receptor layer being formed by applying a powdery composition comprising a dyeable resin on the substrate, wherein said receptor layer has a coated amount in a range of 6 g/m$^2$ or more and 22 g/m$^2$ or less, an arithmetical mean deviation of profile (Ra) in a range of 1.2 μm or less, and a specular gloss of 45° (Gs(45°)) in a range of 10% or less.

2. A thermal transfer-receiving sheet according to claim 1, wherein a back surface layer is formed on a surface of said substrate opposite to another surface on which the receptor layer is disposed.

3. A thermal transfer-receiving sheet according to claim 1, wherein said thermal transfer-receiving sheet has a moisture content in a range of 3.0 weight % or more and 8.0 weight % or less.

4. A thermal transfer-receiving sheet according to claim 1, wherein a surface of said substrate made of a plain paper has physical properties in which a surface texture is in a range of 471 or less in terms of a roughness index, and a surface roughness is in a range of less than 2.1 μm in terms of an arithmetical mean deviation of profile(Ra), less than 23.2 μm in terms of a maximum height(Rmax) and less than 20.8 μm in terms of a mean roughness of ten points(Rz).

5. A thermal transfer-receiving sheet comprising a substrate made of a plain paper and a receptor layer disposed on the substrate, the receptor later being formed by applying a powdery composition comprising a dyeable resin on the substrate, wherein the thickness of the receptor layer is 7 μm or more excluding any portion which may have penetrated the substrate.

6. A thermal transfer-receiving sheet according to claim 5, wherein said thickness is in a range of 7 μm or more and 30 μm or less.

7. A thermal transfer-receiving sheet according to claim 5, wherein a surface of said receptor layer has an arithmetical mean deviation of profile(Ra) in a range of 1.2 μm or less.

8. A thermal transfer-receiving sheet according to claim 5, wherein a surface of said receptor layer has a specular gloss of 45° (Gs(45°)) in a range of 10% or less.

9. A thermal transfer-receiving sheet according to claim 5, wherein a back surface layer is formed on a surface of said substrate opposite to another surface on which the receptor layer is disposed.

10. A thermal transfer-receiving sheet according to claim 5, wherein said thermal transfer-receiving sheet has a moisture content in a range of 3.0 weight % or more and 8.0 weight % or less.

11. A thermal transfer-receiving sheet according to claim 5, wherein a surface of said substrate made of a plain paper has physical properties in which a surface texture is in a range of 471 or less in terms of a roughness index, and a surface roughness is in a range of less than 2.1 μm in terms of an arithmetical mean deviation of profile(Ra), less than 23.2 μm in terms of a maximum height(Rmax) and less than 20.8 μm in terms of a mean roughness of ten points(Rz).

12. A thermal transfer-receiving sheet comprising a substrate made of a plain paper and a receptor layer disposed on the substrate, the receptor layer being formed by applying a powdery composition comprising a dyeable resin on the substrate, wherein a surface of said substrate made of a plain paper has physical properties in which a surface texture is in a range of 471 or less in terms of a roughness index, and a surface roughness is in a range of less than 2.1 μm in terms of an arithmetical mean deviation of profile(Ra), less than 23.2 μm in terms of a maximum height(Rmax) and less than 20.8 μm in terms of a mean roughness of ten points(Rz).

13. A method for manufacturing a thermal transfer-receiving sheet comprising steps of:

applying a powdery composition comprising a dyeable resin on the substrate to form a coated layer; and, fixing the thus formed coated layer by heating and pressing while controlling at least one of a heating temperature, an applied pressure, a heating time and a pressing time to form a receptor layer wherein the powdery composition is applied on the substrate at an amount in a range of 6 g/m$^2$ or more and 22 g/m$^2$ or less and a surface of said receptor layer is made to have a specular gloss of 45° (Gs(45°)) in a range of 10% or less by adjusting the surface roughness and/or the specular gloss of the heating roll or the heating plate.

14. A method for manufacturing a thermal transfer-receiving sheet according to claim 13, wherein said receptor is formed at a thickness of 7 μm or more by controlling an applied amount of the powdery composition in the applying step, and controlling the heating temperature, the applied pressure, the heating time and the pressing time in the fixing step.

15. A method for manufacturing a thermal transfer-receiving sheet comprising steps of:

applying a powdery composition comprising a dyeable resin on the substrate to form a coated layer; and, fixing the thus formed coated layer by means of a heating roll or a heating plate whose surface roughness and/or specular gloss is adjusted to a prescribed value, to form a receptor layer.

16. A method for manufacturing a thermal transfer-receiving sheet according to claim 15, wherein a surface of said receptor layer is made to have an arithmetical mean deviation of profile(Ra) in a range of 1.2 μm or less by adjusting the surface roughness and/or the specular gloss of the heating roll or the heating plate.

17. A method for manufacturing a thermal transfer-receiving sheet comprising steps of:

applying a powdery composition comprising a dyeable resin on the substrate to form a coated layer;

fixing the thus formed coated layer by heating and/or pressing, to form a receptor layer; and, applying, before or after formation of the receptor layer, an aqueous solution or emulsion of a water soluble resin or an emulsion of polyvinylidene chloride on a surface of the substrate opposite to another surface on which the receptor layer is to be disposed.

18. A method for manufacturing a thermal transfer-receiving sheet comprising steps of:

applying a powdery composition comprising a dyeable resin on the substrate to form a coated layer;

fixing the thus formed coated layer by heating and/or pressing, to form a receptor layer; and, spraying the thermal transfer-receiving sheet or an intermediate product thereof with steam to moisten them.

19. A method for manufacturing a thermal transfer-receiving sheet according to claim 18, wherein said thermal transfer-receiving sheet is moistened at a moisture content in a range of 3.0 weight % or more and 8.0 weight % or less by spraying the steam.

* * * * *